US007114190B2

(12) United States Patent
Najarian et al.

(10) Patent No.: US 7,114,190 B2
(45) Date of Patent: Oct. 3, 2006

(54) PROTECTIVE CLOTHING ARTICLE

(75) Inventors: Lisa Najarian, 1018 Chestnut St., Western Springs, IL (US) 60558; Edna Mae London, Citrus Heights, CA (US)

(73) Assignee: Lisa Najarian, Western Springs, IL (US)

( * ) Notice: Subject to any disclaimer, the term of this patent is extended or adjusted under 35 U.S.C. 154(b) by 0 days.

(21) Appl. No.: 10/936,346

(22) Filed: Sep. 7, 2004

(65) Prior Publication Data

US 2006/0048260 A1 Mar. 9, 2006

(51) Int. Cl.
*A41D 13/04* (2006.01)

(52) U.S. Cl. ..... 2/48; 2/247

(58) Field of Classification Search ..... 2/48, 2/46, 47, 49.1–49.5, 50, 88, 69, 51, 52, 247, 2/158, 160, 248–251, 159, 161.6, 167; D2/860–864
See application file for complete search history.

(56) References Cited

U.S. PATENT DOCUMENTS 1,538,982 A * 5/1925 Glover ..... 2/51
1,816,566 A * 7/1931 Burstein et al. ..... 2/48
2,410,639 A * 11/1946 Dorcey ..... 2/48
2,570,848 A * 10/1951 Ozenberger ..... 2/48
2,785,409 A * 3/1957 Lackey ..... 2/51
2,889,556 A * 6/1959 Mehler ..... 2/158
3,174,156 A * 3/1965 Dale et al. ..... 2/115
3,210,773 A * 10/1965 Lewis ..... 2/48
3,428,962 A * 2/1969 Slimovitz ..... 2/48
3,438,062 A * 4/1969 Dobell ..... 2/247
3,624,686 A * 11/1971 Beals ..... 434/98
4,014,045 A * 3/1977 Moyer ..... 2/51
4,218,781 A * 8/1980 Lieberman ..... 2/247
4,302,851 A * 12/1981 Adair ..... 2/158
4,613,991 A * 9/1986 Grover ..... 2/23
4,651,355 A * 3/1987 White ..... 2/247
5,394,565 A * 3/1995 Stewart et al. ..... 2/69
D362,332 S 9/1995 Short ..... D2/864
D395,736 S * 7/1998 Walters ..... D2/864
5,797,144 A * 8/1998 Ciccone ..... 2/144
5,878,439 A * 3/1999 Waters, Jr. ..... 2/161.6
6,079,049 A * 6/2000 Moir ..... 2/69
6,112,372 A 9/2000 Zhou et al. ..... 16/435
6,224,107 B1 5/2001 Smith ..... 281/15.1
D481,197 S * 10/2003 Fusco ..... D2/861
6,643,845 B1 11/2003 O'Dea ..... 2/161.2
6,684,460 B1 2/2004 Cuff ..... 16/435

* cited by examiner

*Primary Examiner*—A. Vanatta
(74) *Attorney, Agent, or Firm*—James A. Gavney Jr.

(57) ABSTRACT

A protective clothing article and a method for making the same are disclosed. In accordance with the embodiments of the invention the protective clothing article includes a plurality of potholders with pocket cavities for covering and protecting a user's hands while handling, holding or manipulating hot or cold objects. The protective clothing article also includes an apron for protecting a portion of the user's body. The potholders are configured to detachably couple to an outer front surface of the apron through a set of attachment features, such that the potholders provide pockets for holding objects while coupled to a front outer surface of the apron.

10 Claims, 4 Drawing Sheets

PROTECTIVE CLOTHING ARTICLE

FIELD OF THE INVENTION

This invention relates to protective articles. More specifically, this invention relates to protective clothing articles.

BACKGROUND OF THE INVENTION

There are a number of different types of protective clothing articles that are available for providing protection from extreme temperatures. For example, there are protective gloves, such as an oven mittens, that are placed over a user's hands to protect the user's hands while handling hot or cold objects. Pieces of thick cloth, such as potholders, are also typically used to protect the user's hands while handling hot or cold objects. In use, potholders are typically wrapped around a portion of the hot or cold object so that the user can pick up or manipulate the hot or cold object.

Protective clothing articles are also available to provide protection from splatter or spillage while performing tasks where splattering or spillage is likely, such as while cooking. For example, there are smocks and aprons that can be worn over other clothing to protect a portion of the user's clothes or body while cooking.

While there are a number protective clothing articles that are available, most of them are not configured to meet multiple objectives. Accordingly, there is a need for functional protective clothing articles that provide protection from a number of different elements and fulfill any number of different purposes.

SUMMARY OF THE INVENTION

The present invention is directed to a potholder, an apron system and a method for making the same. In accordance with the embodiments of the invention a potholder includes a front and back surface. In accordance with the embodiments of the invention, the back surface includes an attachment means for detachably securing a perimeter portion of the potholder to an outer surface of an apron to form a pocket cavity between the back surface of the potholder and the outer surface of the article of clothing. The pocket cavity can be used as a pocket while the potholer is attached to the apron and can be removed to handle, hold or manipulate hot or cold objects.

The potholder can include a layer of insulating material that is sandwiched between two or more layers of an outer material that form the front and back surfaces of the pot holder. The layer of insulating material helps to protect hands and fingers from exposures to extreme temperatures while handling, holding or manipulating hot or cold objects.

In accordance with a preferred embodiment of the invention, a potholder comprises a first section and a second section that forms a pocket cavity. Preferably, the potholder is configured to accommodate a portion of a user's hand. In use, the portion of the user's hand is inserted into the pocket cavity between the first section and the second section to protect the user's hand while handling, holding or manipulating hot or cold objects.

Preferably, one or both of the first section and the second section includes an insulating material. For example, the first section and/or the second section includes a layer of an insulating material that is sandwiched between two or more layers of an outer material, such as described above. The first section and/or the second section can be quilted to secure or hold the layers of insulting material between the two or more layers of the outer material. Quilting also provides a textured surface for gripping the hot or cold objects.

In accordance with further embodiments of the invention, the potholder includes an attachment feature coupled to at least one of first section and the second section for detachably coupling the potholder to an outer surface of an apron. The potholder can be used as a pocket for holding keys, coins, cooking utensils and the like while attached to the outer surface of the apron through the attachment means.

A system in accordance with the embodiments of the invention includes an apron structure and a plurality of potholders, such as described above. The apron structure also preferably includes a plurality of complementary attachment features for attaching the potholders to an outer surface of the apron structure. As described above, the potholders can be used as pockets while attached to the outer surface of the apron. Suitable attachment features and complementary attachment features include, but are not limited to, two-part snaps, buttons and loops, sections of hook and loop fabric, magnets and any combination thereof.

The apron structure is preferably configured with a strap or a belt to tie and secure the apron structure around a user's waist and to cover or protect at least a portion of the user's abdomen and legs. The apron structure can also be configured to secure around the user's neck and to cover or protect a portion of a user's torso.

The potholders and the apron structure described above can have any number of different geometries and can be formed from any number of different materials and combinations of materials, such as woven materials, plastic materials and combinations thereof.

DETAILED DESCRIPTION OF THE INVENTION

Figure 1:
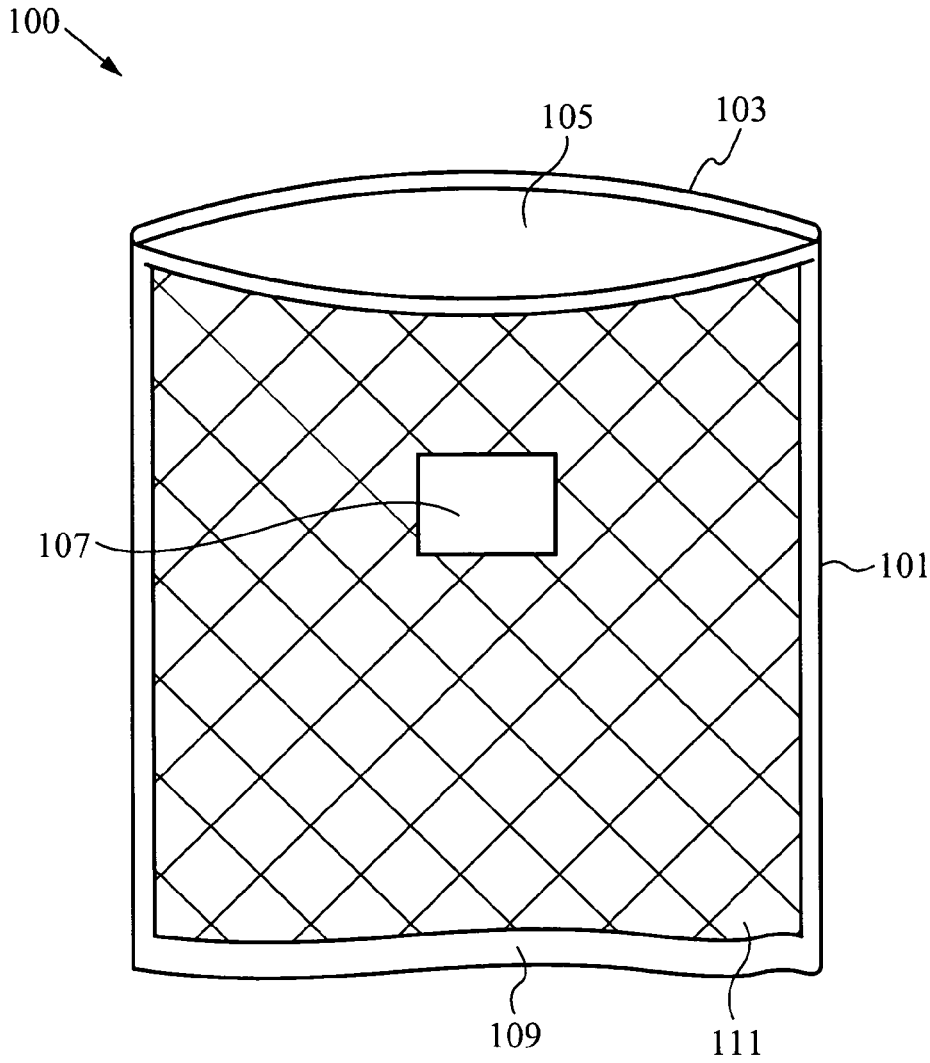
FIG. 1 shows a potholder, in accordance with the embodiments of the invention.

FIG. 1 shows a potholder 100, in accordance with embodiments of the invention. The potholder 100 comprises first section 101 and a second section 103 that form a pocket cavity 105. Preferably, the potholder 100 is configured to accommodate a portion of a user's hands. In use, the portion of the user's hand is inserted into the pocket cavity 105 between the first section 101 and the second section 103. The user can then handle, hold or manipulate hot or cold objects with the potholder 100.

Preferably, one or both of the first section 101 and the second section 103 include an insulating material. For example, the first section 101 and/or the second section 103 include a layer of an insulating material (not shown) that is sandwiched between two or more layers of an outer material used to form the first section 101 and the second section 103. The first section 101 and/or the second section 103 can be quilted or stitched through the insulating layer and the two or more layers of the outer material thereby forming quilted section 111. Quilting the section 111 helps to secure or hold the layer of insulting material between the two or more layers of the outer material. The quilted section 111 also provides texture for gripping the hot or cold objects. The potholder 100 can also include a decorative or textured boarder 109.

Still referring to FIG. 1 the potholder 100 includes an attachment feature 107 coupled to at least one of the first section 101 and the second section 103 for detachably coupling the potholder 100 to an outer surface of an apron with a complementary attachment feature, such as described in detail below. The potholder 100 is configured to be used as a pockets for holding keys, coins, cooking utensils and the like while the potholder 100 is attached to the outer surface of the apron through the attachment feature 107. The attachment feature 107 and the complementary attachment feature can include one or more of a snap, a button, a loop, a hook, a section hook fabric, a section loop fabric and a magnet to name a few.

Figure 2:
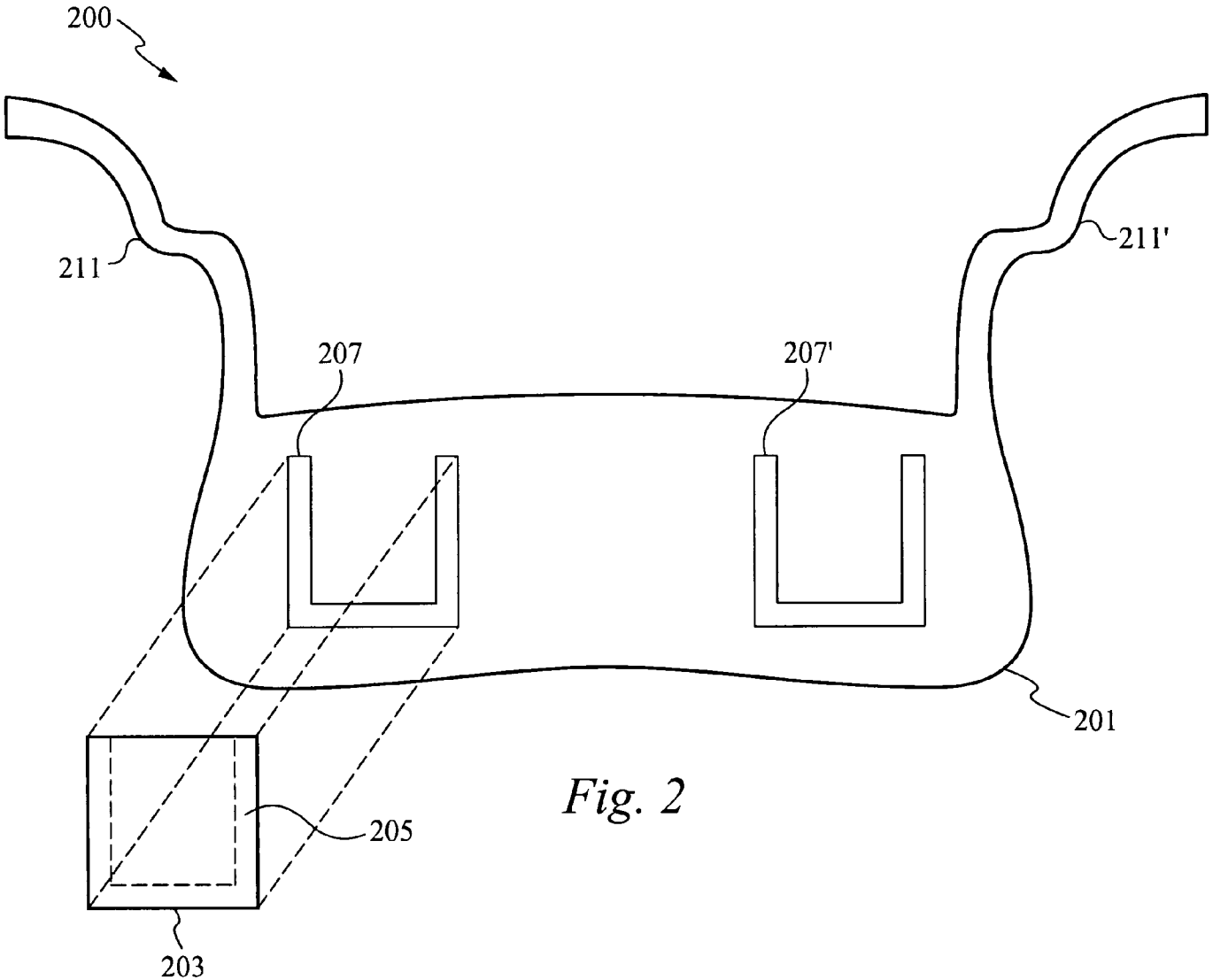
FIG. 2 shows an apron system, in accordance with the embodiments of the invention.

Referring now to FIG. 2, an apron system 200 in accordance with the embodiments of the invention includes an apron structure 201 with one or more complementary attachment features 207 and 207' for attaching one or more potholders 203 to an outer surface of the apron structure 201. The potholder 203 includes a front and back surface. The back surface of the potholder 203 includes an attachment feature 205 that can mate, engage or otherwise detachably couple to the one or more complementary attachment features 207 and 207' on the outer surface of the apron structure 201. Suitable complementary attachment features 207 and 207' and attachment feature 205 include, but are not limited to, two-part snaps, buttons and loops, sections of hook and loop fabric, magnets and any combination thereof.

Still referring to FIG. 2, the potholder 203 can include a layer of insulating material that is sandwiched between two or more layers of an outer material that form the front surface and the back surface of the pot holder 203, such as described above with reference to FIG. 1. With the potholder 203 attached to the apron structure 201, the back surface of the potholder 203 and the outer surface of the apron structure 201 form a pocket cavity that can be used to hold keys, coins, cooking utensils and the like. The potholder 203 can also be readily detached from the apron structure 201 and used to protect a user's hand while handling, holding or manipulating hot or cold objects.

Figure 4:
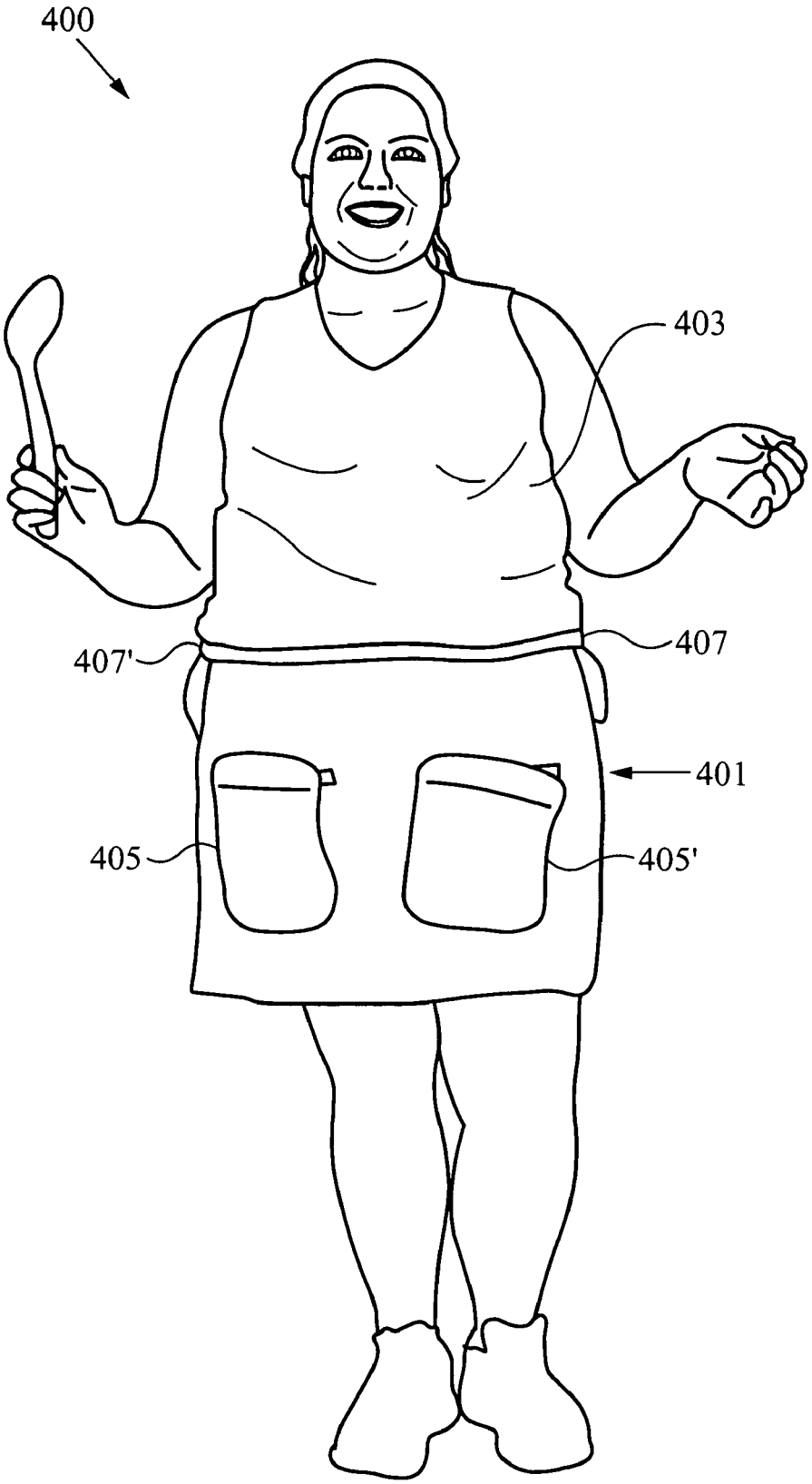
FIG. 4 shows a person wearing an apron system with potholders, as shown in FIG. 3, attached to an apron structure, in accordance with the embodiments of the invention.

The apron structure 201 preferably includes straps or belts 211 and 211' to secure the apron structure 201 around a user's waist and to cover or protect at least a portion of the user's abdomen and legs from splatter or spillage, such as shown in FIG. 4. The apron structure 201 can also be a full body apron structure (not shown) that secures around the user's neck to cover and also protect a portion of the user's torso.

Figure 3A:
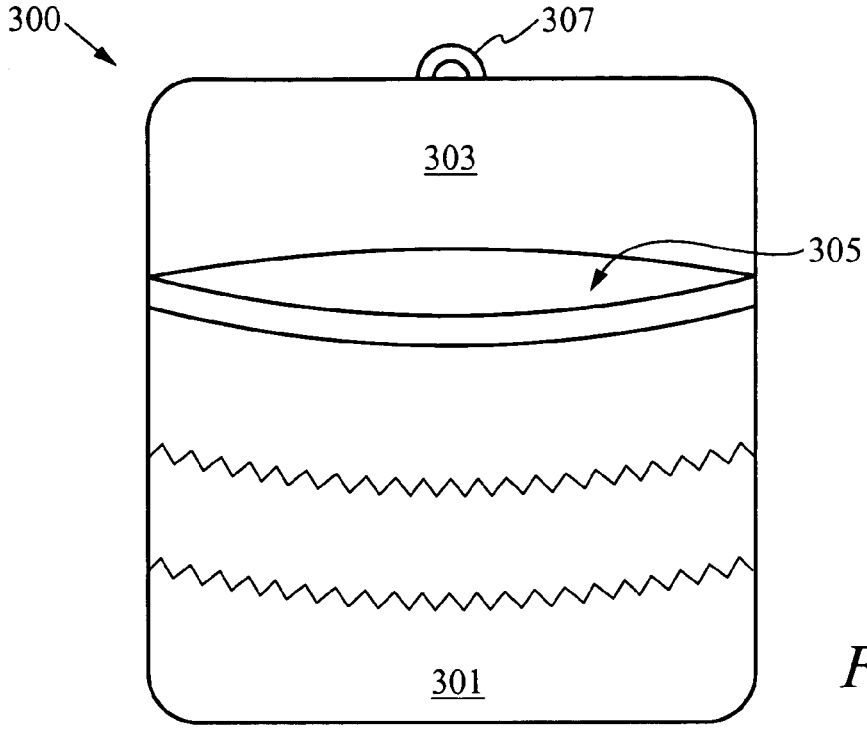
FIGS. 3*a–b* show front and back views of a potholder, in accordance with a preferred embodiment of the invention.

FIG. 3*a* shows a front view of a potholder 300, in accordance with preferred embodiments of the invention. The potholder 300 comprises first section 301 and a second section 303 that form a pocket cavity 305. Preferably, the potholder 300 is configured to accommodate a portion of a user's hand. The potholder 300 can also include a loop structure 307 for hanging the potholder 300 on a wall using, for example, a hook or a nail. Also, the first section 301 can be decorated or detailed in any number of different ways to provide both function and beauty to the potholder 300.

Figure 3B:
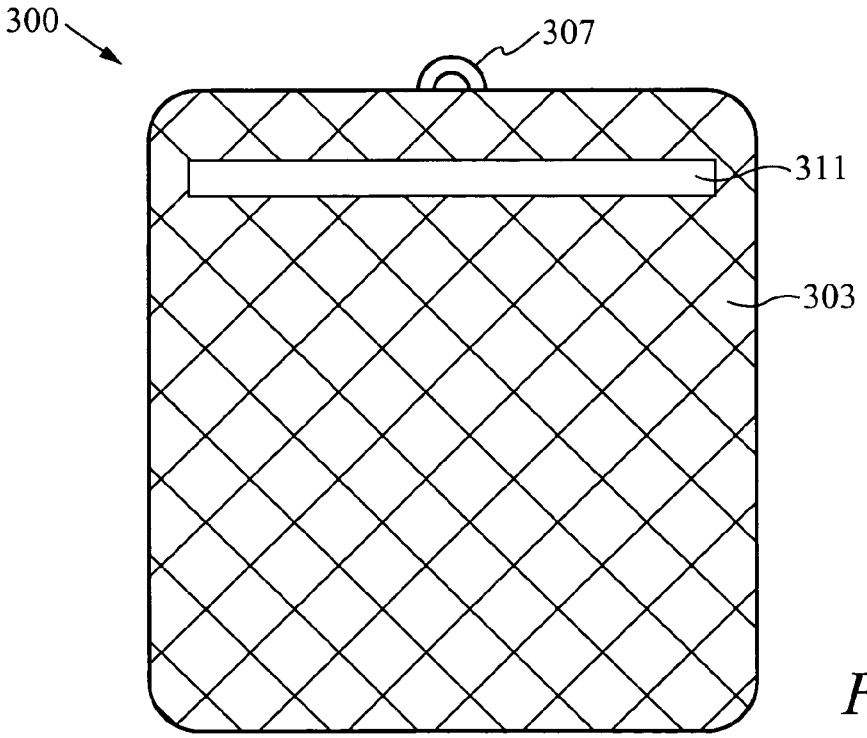

FIG. 3*b* shows a back view of the potholder 300. The second section 303 includes a layer of an insulating material (not shown) that is sandwiched between two or more layers of an outer material that form the second section 303. The second section 303 is preferably quilted, as described previously.

The potholder 300 also includes an attachment feature 311 attached to an outer surface of the second section 303 for detachably coupling the potholder 300 to a complementary attachment feature on an outer surface of an apron structure, such as described with reference to FIG. 2 and FIG. 4. Preferably, the attachment feature 311 is a strip of hook or loop fabric that couples to a complementary piece of hook or loop fabric on the outer surface of the apron structure (201, FIG. 2). As described previously, the cavity 305 of the potholder 300 can be used as a pocket for holding keys, coins, cooking utensils and the like while the potholder 300 is attached to the outer surface of the apron structure and can be detached form the outer surface of the apron structure to be used to protect a user's hand while handling, holding or manipulating hot or cold objects.

FIG. 4 shows a view 400 of a person 403 wearing an apron system 401, in accordance withe the embodiments of the present invention. The apron system 401 includes a plurality of pot holders 405 and 405', such as described with reference to FIG. 3, that couple to an outer surface of the apron system 401 through attachment features, such as described in detail above. The potholders 405 and 405' are preferably substantially rectangular as shown and are configured to couple to the apron structure though pieces or strips of hook and loop fabric. The apron system 401 also preferably includes straps 407 and 407' for securing the apron system 401 around the waist of the person 403.

The present invention provides a multi-functional protective clothing article. The multi-functional protective clothing article includes an apron that provides a user protection from splatter or spillage and detachable potholders that can be used for pockets and that can be easily accessed and detached by the user while wearing the apron to provide protection for the user's hands while handling, holding or manipulating hot or cold objects.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiments chosen for illustration without departing from the spirit and scope of the invention. Specifically, it will be apparent to one of ordinary skill in the art that the potholders and the apron structure of the present invention can be fashioned to have any number of different goemetries and can be formed from a variety of different materials.

The invention claimed is:

1. A protective clothing article comprising:

a) an apron structure;

b) pocket shaped potholders comprising quilted insulating surfaces for holding hot objects; and c) means for detachably coupling the pocket shaped potholders to an outer surface of the apron structure and thereby form pockets between portions of the outer surface of the apron structure and surfaces of the pocket shaped potholders.

2. The protective clothing article of claim 1, wherein the apron structure includes straps for securing the apron structure around a waist of a person.

3. The protective clothing article of claim 1, wherein means for detachably coupling the pocket shaped potholders to the outer surface of the apron structure comprises attachment features attached to pocket shaped potholders and complementary attachment features attached to the outer surface of the apron structure.

4. The protective clothing article of claim 3, wherein the attachment features and the complementary attachment features comprise at least one of a snap, a button, a loop, a hook, a section hook fabric, a section loop fabric and a magnet.

5. The protective clothing article of claim 1, wherein the pocket shaped potholders are substantially rectangular.

6. The protective clothing article of claim 1, wherein the apron structure and the pocket shaped potholders are formed from a woven material.

7. A detachable pocket shaped potholder comprising:

a) a first section formed from a woven material;

b) a second section formed from a woven material, wherein at least one of the first section and second section have a guilted surface for handling hot objects c) an insulating material positioned between the first and second section; and d) an attachment feature coupled to at least one of the first section and the second section for detachably coupling the pocket shaped potholder to an article of clothing and thereby forming a pocket between a surface of the article of clothing and the pocket shaped potholder.

8. The detachable pocket shaped potholder of claim 7, wherein the attachment feature comprises at least one of a snap, a button, a loop, a hook, a section hook fabric, a section loop fabric and a magnet.

9. The detachable pocket shaped potholder of claim 7, wherein the first and second sections are substantially rectangular.

10. A method of making an apron system, the method comprising:

a) forming pocket shaped potholders each having attachment features and an insulating layer formed from a woven material; and b) forming an apron having complementary attachment features for coupling each of the pocket shaped potholders to an outer surface of the apron, the apron further comprising means for securing around a waist of a person, wherein a surface of each of the pocket shaped potholders and the outer surface of the apron form single cavity pockets between each of the pocket shaped potholders and the outer surface of the apron while attached together through the attachment features and the complementary attachment features.

* * * * *